US012146245B2

(12) United States Patent
Vitarana et al.

(10) Patent No.: US 12,146,245 B2
(45) **Date of Patent: *Nov. 19, 2024**

(54) FABRIC WITH BI-DIRECTIONAL THICKNESS VARIATION

(71) Applicant: MAS INNOVATION (PRIVATE) LIMITED, Battaramulla (LK)

(72) Inventors: Ranil Kirthi Vitarana, Battaramulla (LK); Sithila Dassanayake, Battaramulla (LK); Dilru Roshan Ratnaweera, Battaramulla (LK); Hetti Arachchige Malaka Chathuranga Perera, Battaramulla (LK); Dodangodage Indika Sanjeewa Wickramaratne, Battaramulla (LK)

(73) Assignee: MAS INNOVATION (PRIVATE) LIMITED, Battaramulla (LK)

( * ) Notice: Subject to any disclaimer, the term of this patent is extended or adjusted under 35 U.S.C. 154(b) by 0 days.

This patent is subject to a terminal disclaimer.

(21) Appl. No.: 18/250,029

(22) PCT Filed: Aug. 24, 2021

(86) PCT No.: PCT/SG2021/050494
§ 371 (c)(1),
(2) Date: Apr. 21, 2023

(87) PCT Pub. No.: WO2022/086438
PCT Pub. Date: Apr. 28, 2022

(65) Prior Publication Data

US 2023/0389625 A1 Dec. 7, 2023

(30) Foreign Application Priority Data

Oct. 21, 2020 (SG) ..... 10202010445Y

(51) Int. Cl.
*D04B 1/10* (2006.01)
*A41C 3/12* (2006.01)
(Continued)

(52) U.S. Cl.
CPC ..... *D04B 1/108* (2013.01); *A41C 3/12* (2013.01); *A41C 3/144* (2013.01); *D04B 1/12* (2013.01);
(Continued)

(58) Field of Classification Search
CPC ..... D04B 1/102; D04B 1/108; D04B 1/12; D04B 1/246; D04B 1/123; D04B 1/18
See application file for complete search history.

(56) References Cited

U.S. PATENT DOCUMENTS 6,156,406 A * 12/2000 Rock ..... B32B 5/26 428/86
6,755,052 B1 * 6/2004 Sytz ..... D04B 1/18 66/196
(Continued)

FOREIGN PATENT DOCUMENTS

WO 2016197051 A1 12/2016
WO 2019197319 A1 10/2019

OTHER PUBLICATIONS

International Search Report issued in International Application No. PCT/SG2021050494, mailed on Oct. 29, 2021 (4 pages).
(Continued)

*Primary Examiner* — Danny Worrell
(74) *Attorney, Agent, or Firm* — Osha Bergman Watanabe & Burton LLP

(57) ABSTRACT

Disclosed herein is a weft knit spacer fabric (200) having variable thicknesses, comprising a first surface layer (210) formed from a first set of yarn (215); a second surface layer (220) formed from a second set of yarn (225); and a set of
(Continued)

spacer yarn (230) between the first and second surface layers (210, 220), where the thickness is varied by varying in each course one or both of: the density of tuck stitches (235) formed by the set of spacer yarn (230) with the first and/or second surface layers (210, 220); and the thickness of the spacer yarn (230) in each course, provided that when the fabric (200) has a free-standing 3-dimensional shape, it is a moulded fabric.

18 Claims, 7 Drawing Sheets

(51) Int. Cl.

| | |
|---|---|
| ***A41C 3/14*** | (2006.01) |
| ***D04B 1/12*** | (2006.01) |
| ***D04B 1/18*** | (2006.01) |
| ***D04B 1/24*** | (2006.01) |

(52) U.S. Cl.
CPC ..... *D04B 1/18* (2013.01); *D04B 1/24* (2013.01); *D04B 1/246* (2013.01); *D10B 2401/041* (2013.01); *D10B 2403/022* (2013.01); *D10B 2501/02* (2013.01)

(56) References Cited

U.S. PATENT DOCUMENTS

| | | | | |
|---|---|---|---|---|
| 6,779,369 | B2 * | 8/2004 | Shepherd | D04B 1/126 66/196 |
| 7,380,420 | B1 * | 6/2008 | Liu | D04B 21/18 66/196 |
| 7,849,715 | B2 * | 12/2010 | Starbuck | A41C 5/00 66/196 |
| 7,913,520 | B1 * | 3/2011 | Chen | D04B 1/16 66/196 |
| 9,677,209 | B2 * | 6/2017 | Daube | D04B 23/02 |
| 11,708,651 | B2 * | 7/2023 | Lee | D04B 7/04 66/169 R |
| 11,819,064 | B2 * | 11/2023 | Montgomery | D04B 1/246 |
| 2004/0097151 | A1 | 5/2004 | McMurray | |
| 2020/0181813 | A1 * | 6/2020 | Meir | D04B 15/362 |
| 2020/0354867 | A1 * | 11/2020 | Mueller | B68G 7/02 |

OTHER PUBLICATIONS

Written Opinion issued in International Application No. PCT/SG2021050494, mailed on Oct. 29, 2021 (7 pages).

* cited by examiner

FABRIC WITH BI-DIRECTIONAL THICKNESS VARIATION

CROSS-REFERENCE TO RELATED APPLICATION

This application is a national phase application of PCT/SG2021/050494, filed on Aug. 24, 2021, which claims priority to Singapore application Ser. No. 10202010445Y, filed on Oct. 21, 2020. The contents of these applications are hereby incorporated by reference in their entirety.

FIELD OF INVENTION

The current invention relates to a textile material product formed from knitting that has bi-directional thickness variation, making it suitable for use in 3-dimensional objects, such as bras, shoulder pads and the like.

BACKGROUND

The listing or discussion of a prior-published document in this specification should not necessarily be taken as an acknowledgement that the document is part of the state of the art or is common general knowledge.

Foam or polyurethane (PU) bra cups are not sustainable in many ways. For example, the use of the starting raw materials and the method of manufacture is not sustainable, and the final product also causes problems in terms of its disposal once its useful life has been completed. As such, there is a need to find alternative products and methods of manufacture that are at least more sustainable in terms of manufacture and use of raw materials.

SUMMARY OF INVENTION

The current invention provides a sustainable alternative solution for PU bra cups (and associated products). The invention relates to a textile material that has bi-directional thickness variation, which may (or may not) be a moulded product. That is, the product may be formed by flat knitting to generate a textile material that has bi-directional thickness variation, which may be flat or have some 3-dimensionality and this product may then be subjected to a moulding step to impart to the product a required 3-dimensionality that may then be free-standing. That is, the moulding step may enable the product to be provided with the required depth, profile and contours without altering the bi-directional thickness variation of the original knitted material. In the knitting process the thickness variation (the thickness required for nipple concealment or support) will be created as required.

The materials used can be sustainable (e.g. recycled materials, bio-based materials, and recyclable materials) and the process enables less wastage during manufacturing, including low energy consumption compared to traditional PU moulding (when moulding is used).

The invention will now be described by reference to the following numbered clauses.

1. A weft knit spacer fabric having variable thicknesses, the fabric comprising:
   - a first surface layer formed from a first set of yarn;
   - a second surface layer formed from a second set of yarn; and
   - a set of spacer yarn between the first and second surface layers, where
   - the fabric is formed from a plurality of courses of the sets of first, second and spacer yarns, where each course is connected to at least one other course in a wale direction, wherein the thickness is varied by varying one or both of:
   - the density of tuck stitches along each course, where each tuck stitch is formed by the set of spacer yarn with the first and/or second surface layers; and
   - the thickness of the spacer yarn in each course, provided that when the fabric has a free-standing 3-dimensional shape, it is a moulded fabric.

2. The fabric according to Clause 1, wherein at least one course varies the density of tuck stitches and at least one course varies the thickness of the set of spacer yarn.

3. The fabric according to Clause 1 or Clause 2, wherein the sets of first and second yarns each comprise an elastic material.

4. The fabric according to any one of the preceding clauses, wherein the first and second sets of yarns each comprise a main yarn and a platting yarn, where each main yarn forms an outer surface and the platting yarn forms an interior surface of the respective first and second surface layers.

5. The fabric according to Clause 4, wherein the platting yarn of each of the first and second sets of yarns comprises a yarn with elastic properties.

6. The fabric according to any one of the preceding clauses, wherein the fabric is selected from one or more of:
   - (a) a flat fabric, apart from the variable thickness;
   - (b) a fabric that is patterned to provide a non-free-standing 3-dimensional shape that has an internal volume defined by the surface of the first or second surface layer, where the fabric is a moulded fabric; and
   - (c) a fabric that is patterned to provide a free-standing 3-dimensional shape that has an internal volume defined by the surface of the first or second surface layer, optionally wherein the first and second yarns comprise at least 15 wt % of an elastic material (e.g. elastane), where the fabric is a moulded fabric.

7. The fabric according to any one of the preceding clauses, wherein the fabric is patterned to provide one of a bra cup, a bra cookie and a bra.

8. The fabric according to Clause 7, wherein the fabric is patterned to provide one or more bra cup zones or one or more bra cookie zones.

9. The fabric according to Clause 8, wherein each bra cup or bra cookie zone is patterned to have a first, a second and a third tuck stitch region, each region having a different density of tuck stitches, such that:
   - the first region corresponds to an outer peripheral region of the cup and has a tuck stitch density lower than the second region;
   - the second region corresponds to a region of the cup between the first and third regions and has a tuck stitch density lower than the third region; and
   - the third region corresponds to a central region of the cup and has a tuck stitch density higher than the first and second regions.

10. The fabric according to Clause 8 or Clause 9, wherein each bra cup or bar cookie zone is patterned to have a first, a second, a third, a fourth and a fifth spacer yarn thickness region, each region having a different thickness for the sets of spacer yarn, such that:
   - the first spacer yarn region corresponds to an outer peripheral region of the cup and has a set of spacer yarn with a diameter lower than a set of spacer yarn used in the second region;
   - the second spacer yarn region corresponds to a region of the cup between the first and third regions and has a set of spacer yarn with a diameter lower than a set of spacer yarn used in the third region;

the third spacer yarn region corresponds to a central region of the cup and has a spacer yarn diameter higher than a spacer yarn used in the first and second regions;

the fourth spacer yarn region corresponds to a region of the cup between the third and fifth spacer yarn regions and has a set of spacer yarn with a diameter lower than a set of spacer yarn used in the third region; and the fifth spacer yarn region corresponds to an outer peripheral region of the cup and has a set of spacer yarn with a diameter lower than a set of spacer yarn used in the fourth region.

11. The fabric according to any one of the preceding clauses, wherein the fabric is a moulded fabric that provides a free-standing 3-dimensional shape that has an internal volume defined by the surface of the first or second surface layer.

12. The fabric according to any one of the preceding clauses, wherein the length of all tuck stitches is substantially identical.

13. The fabric according to any one of the preceding clauses, wherein the fabric is patterned to provide one of a bra cup, a bra cookie and a bra.

14. The fabric according to any one of Clauses 1 to 13, wherein the fabric is patterned to provide a free-standing 3-dimensional shape that has an internal volume defined by the surface of the first or second surface layer, where the fabric is a moulded fabric.

15. The fabric according to Clause 14, wherein the 3-dimensional shape is at least partly supplied by a 3-dimensional knitting pattern.

16. The fabric according to Clause 14 or Clause 15, wherein the first and second yarns comprise at least 15 wt % of an elastic material (e.g. elastane).

17. The fabric according to any one of Clauses 14 to 16, wherein the fabric is patterned to provide one of a bra cup, a bra cookie and a bra.

18. The fabric according to Clause 17, wherein the fabric is one of a bra cup or a bra cookie that is patterned to have a first, second and third region, each region having a different density of tuck stitches, such that:

the first region corresponds to an outer peripheral region of the cup and has a tuck stitch density lower than the second region;

the second region corresponds to a region of the cup between the first and third regions and has a tuck stitch density lower than the third region;

the third region corresponds to a central region of the cup and has a tuck stitch density higher than the first and second regions.

19. The fabric according to Clause 17 or Clause 18, wherein each bra cup or bar cookie zone is patterned to have a first, a second, a third, a fourth and a fifth spacer yarn thickness region, each region having a different thickness for the sets of spacer yarn, such that:

the first region corresponds to an outer peripheral region of the cup and has a set of spacer yarn with a diameter lower than a set of spacer yarn used in the second region;

the second region corresponds to a region of the cup between the first and third regions and has a set of spacer yarn with a diameter lower than a set of spacer yarn used in the third region;

the third region corresponds to a central region of the cup and has a spacer yarn diameter higher than a spacer yarn used in the first and second regions the fourth region corresponds to a region of the cup between the third and fifth regions and has a set of spacer yarn with a diameter lower than a set of spacer yarn used in the third region;

the fifth region corresponds to an outer peripheral region of the cup and has a set of spacer yarn with a diameter lower than a set of spacer yarn used in the fourth region.

20. A garment comprising a weft knit spacer fabric having variable thicknesses as defined in any one of Clauses 1 to 19.

DRAWINGS

DESCRIPTION

Figure 1:
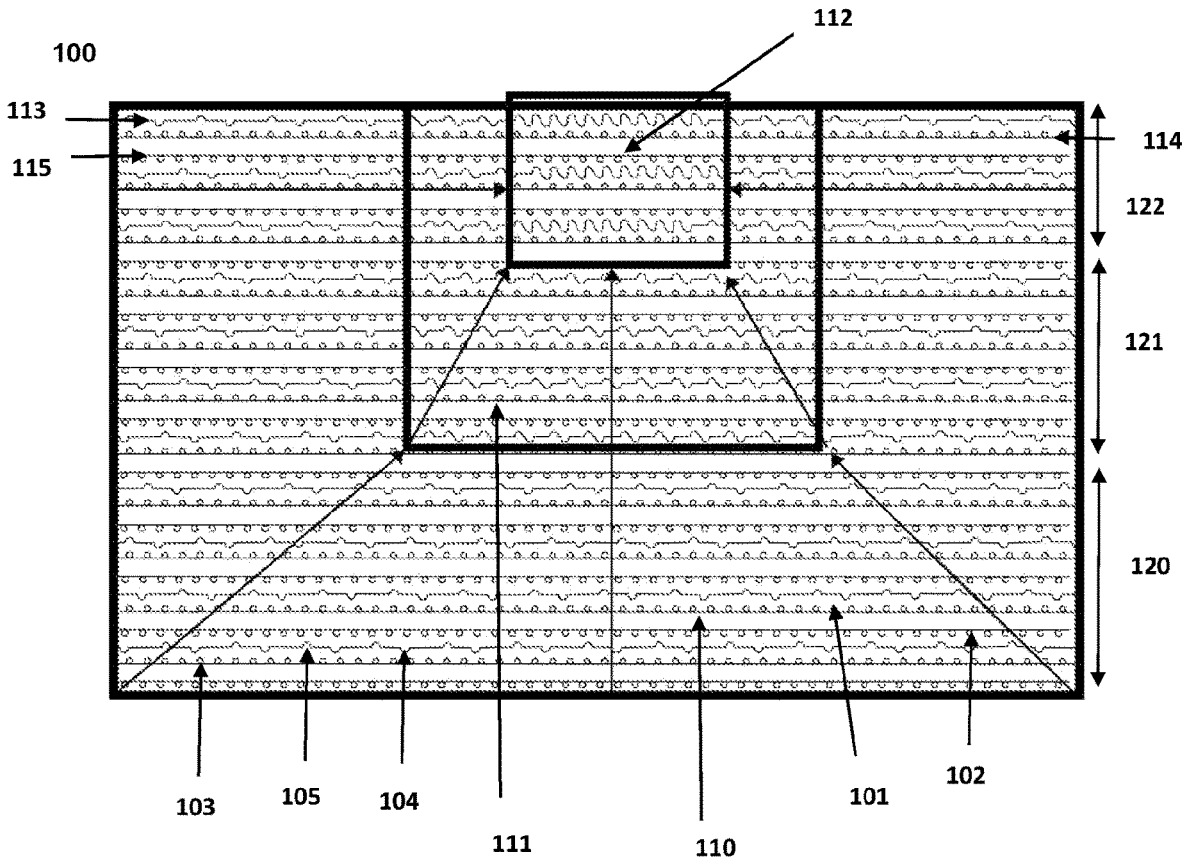
FIG. 1 shows a pattern for a weft knit spacer fabric of the invention.

In a first aspect of the invention, there is provided a weft knit spacer fabric having variable thicknesses, the fabric comprising:

a first surface layer formed from a first set of yarn;

a second surface layer formed from a second set of yarn; and a set of spacer yarn between the first and second surface layers, where the fabric is formed from a plurality of courses of the sets of first, second and spacer yarns, where each course is connected to at least one other course in a wale direction, wherein the thickness is varied by varying one or both of:

the density of tuck stitches along each course, where each tuck stitch is formed by the set of spacer yarn with the first and/or second surface layers; and the thickness of the spacer yarn in each course, provided that when the fabric has a free-standing 3-dimensional shape, it is a moulded fabric.

In embodiments herein, the word "comprising" may be interpreted as requiring the features mentioned, but not limiting the presence of other features. Alternatively, the word "comprising" may also relate to the situation where only the components/features listed are intended to be present (e.g. the word "comprising" may be replaced by the phrases "consists of" or "consists essentially of"). It is explicitly contemplated that both the broader and narrower interpretations can be applied to all aspects and embodiments of the present invention. In other words, the word "comprising" and synonyms thereof may be replaced by the phrase "consisting of" or the phrase "consists essentially of" or synonyms thereof and vice versa.

The phrase, "consists essentially of" and its pseudonyms may be interpreted herein to refer to a material where minor impurities may be present. For example, the material may be greater than or equal to 90% pure, such as greater than 95% pure, such as greater than 97% pure, such as greater than 99% pure, such as greater than 99.9% pure, such as greater than 99.99% pure, such as greater than 99.999% pure, such as 100% pure.

For the avoidance of doubt, the first and second sets of yarns may be the same or different. In addition, the first and second sets of yarns may be formed from one or more materials. For example, the first set of yarn may be formed from an inelastic yarn, an elastic yarn or a combination of both. That is, the first set of yarn may be formed using any suitable material for use in textiles that may or may not include an elastic material as the entirety of the yarn or as part of a blended yarn.

Weft directional tuck frequency (or density) will determine the thickness variation. If the tuck stiches are closer to each other (all needle tuck) then the thickness is high. If the tuck stiches are far from each other, then the thickness will be low. This frequency can go down to the level of no tuck stiches at all. When used herein, the density of tuck stitches along a course affects the thickness of the course itself across its length. For example, the density of tuck stitches may be the same across the course length. In this case, the thickness of the particular course will be even across its length, though it may be thicker or thinner than adjacent courses even when they make use of the same thickness of spacer yarn, as the adjacent courses may use a higher or lower density of tuck stitches across their length. Alternatively, the density of the tuck stitches may vary along the course. For example, there may be a low density (or no) tuck stitches at peripheral regions of the course, while the central region of the course may have a high density of tuck stitches. As such, the course shows a thicker middle than peripheral regions. As will be appreciated any variation of this the above is possible to achieve the desired thickness across the courses.

As will be appreciated, in embodiments of the invention that may be mentioned herein, at least one course in the fabric may vary the density of tuck stitches and at least one course may vary the thickness of the set of spacer yarn.

The thickness of the fabric may also be controlled by varying the thickness of the spacer yarns used in the set of spacer yarn. This may enable courses that have an identical density of tuck stitches to nevertheless have a different thickness due to the difference in thicknesses of the spacer yarns used in the respective courses. Examples of thickness of spacer yarns that may be used herein may be from 10 to 700 Denier. For example, a thin spacer yarn may have a thickness of from 10 to 50 Denier, such as from 15 to 40 Denier, such as about 17 Denier. A medium-thickness spacer yarn may have a thickness of from 50 to 300 Denier, while a thick spacer yarn may have a thickness of from 300 to 700 Denier, such as from 400 to 600 Denier. In addition, if one wants to generate a very thin fabric zone, then this may be possible through the use of a set of spacer yarns that includes a yarn that is elastic or stretchable in nature.

Any suitable textile yarn may be used in the first, second and spacer sets of yarns. However, specific types of yarn may be required, depending on the desired functionality.

FIG. 1 depicts a pattern for a fabric 100 according to the current invention. The frequency of tuck stitches controls the thickness of the fabric in one direction (e.g. in the X direction), while the yarn count (diameter/thickness) of the set of spacer yarn used allows for the thickness of the fabric to be controlled in the other direction (e.g. in the Y direction). Thus, a combination of frequency of tuck stiches and the different (various thickness) spacer yarns used along/across the fabric, allows for thickness variation in both the X and Y directions.

In FIG. 1, the fabric 100 is formed by a plurality of courses (e.g. course 101). A typical course is formed by front (e.g. denoted by the notation shown as 102), back (e.g. denoted by the notation shown as 103), front tuck (e.g. denoted by the notation shown as 104) and back tuck stitches (e.g. denoted by the notation shown as 105), or combinations thereof. As shown, the fabric contains three tuck stitch density zones 110, 111 and 112, each with a varying density of tuck stitches. The first zone 110 has the lowest density of tuck stiches, the second zone 111 has a higher number of tuck stiches and so it has a greater thickness than the first zone 110. However, the third zone has the highest density and so it has an even greater thickness compared to the second zone. It is noticeable that the tuck stitch density may vary within a course, with courses 113, 114 and 115 showing all three densities within a single course.

In addition, to the tuck stitch density zones, the thickness of the fabric can also be influenced by type of material used to generate the tuck stitches. Again, this is illustrated in FIG. 1, where there are three separate spacer yarn thickness zones 120, 121 and 122. The first zone 120 uses a thin spacer yarn, the second zone 121 uses a medium-thickness spacer yarn, while the third zone 122 uses a thick spacer yarn (the thicknesses are as defined hereinbefore).

The combination of the control of tuck stitch density and the thickness of the spacer yarn used in any given course allows great control over the thickness of a fabric at any given point. For example, for a bra cup or cookie, there may be an area that is preferably thinner, where support is needed, but concealment is not significantly required (such as the main body of a breast). However, there may also be an area where concealment is desired, such as in the area of the nipples and this area may require a much thicker material than for other parts of the bra in order to provide the desired concealment. This can be readily provided, as shown in FIG. 1, where the combination of a high tuck-stitch density and the use of the thick spacer yarn generates a region 112 suitable for nipple concealment, with the region 111 being suitable to cover the areola and the region 110 being suitable for the rest of the breast volume/area. Therefore, the fabrics disclosed herein enable a great degree of control over the thickness of a fabric at all points across the length of the fabric.

Figure 2:
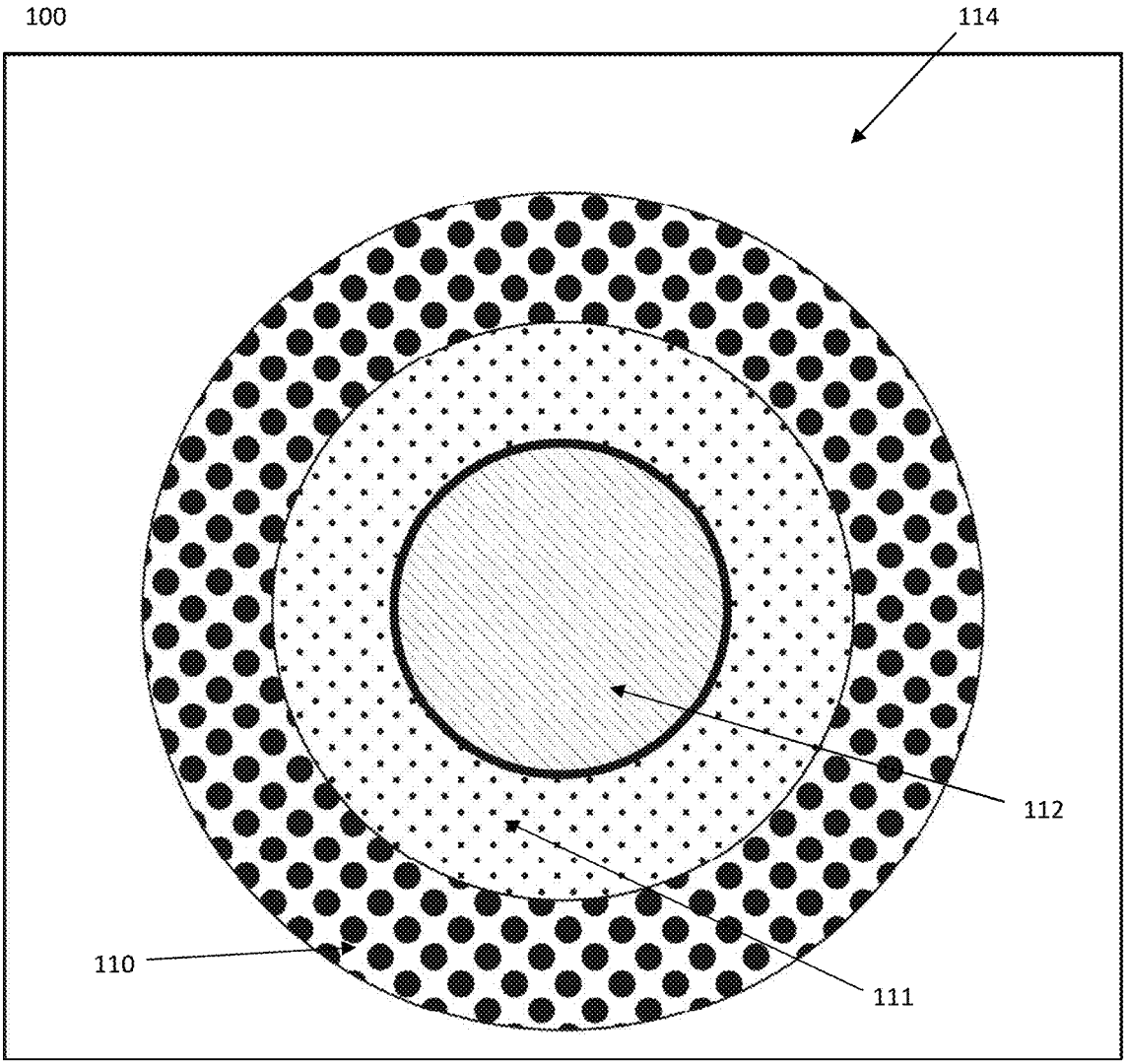
FIG. 2 shows a pattern for a weft knit spacer fabric suitable for a bra cup, and depicts regions having different densities of tuck stitches.
Figure 3:
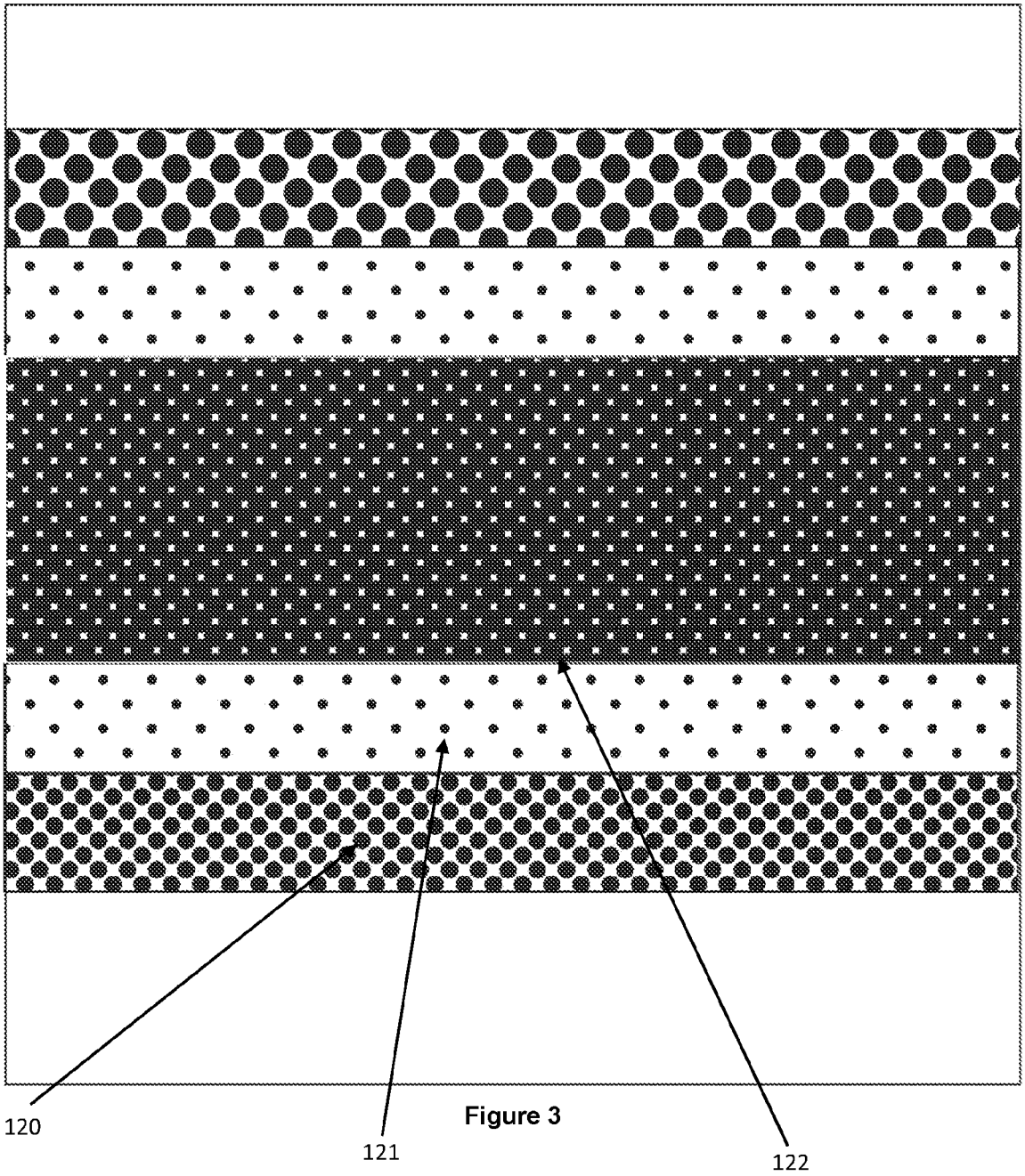
FIG. 3 shows a pattern for a weft knit spacer fabric suitable for a bra cup, and depicts regions having different spacer yarn thicknesses.

FIGS. 2 and 3 relate specifically to a bra cup and depict a plan view of the 3-D cup generated herein for the purposes of clarity. Turning to FIG. 2, there is provided a bra cup fabric 100 formed from three zones 110, 111 and 112, which correspond to the equivalent regions discussed above in respect of FIG. 1, with the first region 110 corresponding to a region with the lowest density of tuck stitches and third region 112 corresponding to the region with the highest level of tuck stitches. As shown in FIG. 3, varying the thickness of the spacer yarn in complimentary zones 120, 121 and 122 allows for a desirable thickness variation to be obtained across the entirety of the fabric (zone 120 corresponding to the thin spacer yarn, with zone 122 corresponding to the thick spacer yarn), thereby generating a unitary objection that can provide support to a user's breast, while at the same time providing suitable nipple concealment. It will be appreciated that in FIG. 2, there may be a fourth region 114 which may correspond to the thinnest possible material and may be entirely flat without any thickness variation (e.g. it may be formed from a single jersey, bird's eye jacquard and the like). As will also be appreciated, it may be possible to add a tunnel to this thinnest area so as to provide an area in which to insert a wire for additional support for a user's breasts.

As will be appreciated, the design used in FIGS. 2 and 3 is one of many possible variations and, while three thickness zones may be used in other embodiments, the thickest one may not always occupy the central region. For example, the thickness might vary from one side to the other continuously. As will also be appreciated, any suitable number of thickness zones may be used to provide a desired fabric.

Figure 4:
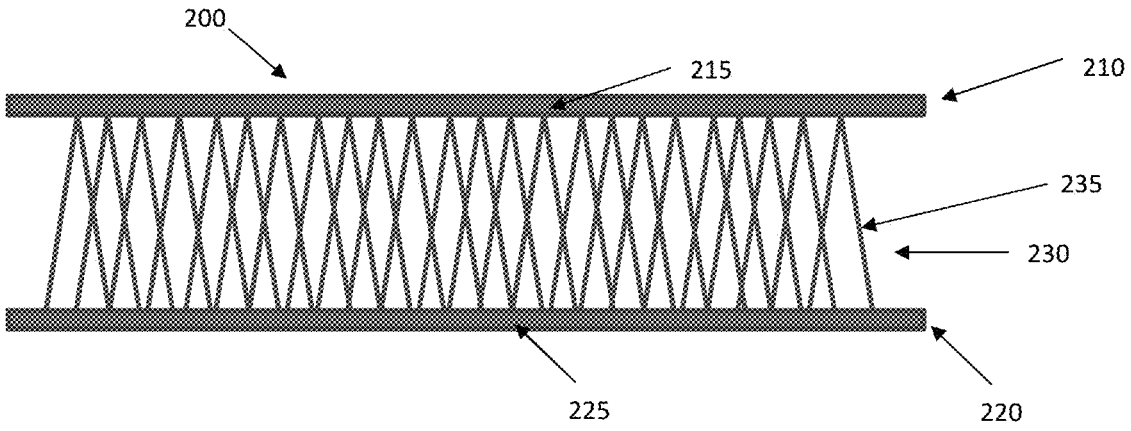
FIG. 4 shows a suitable cross-section for a fabric of the invention, in which the first and second surface layers are formed from a single yarn that may be the same or different.
Figure 5:
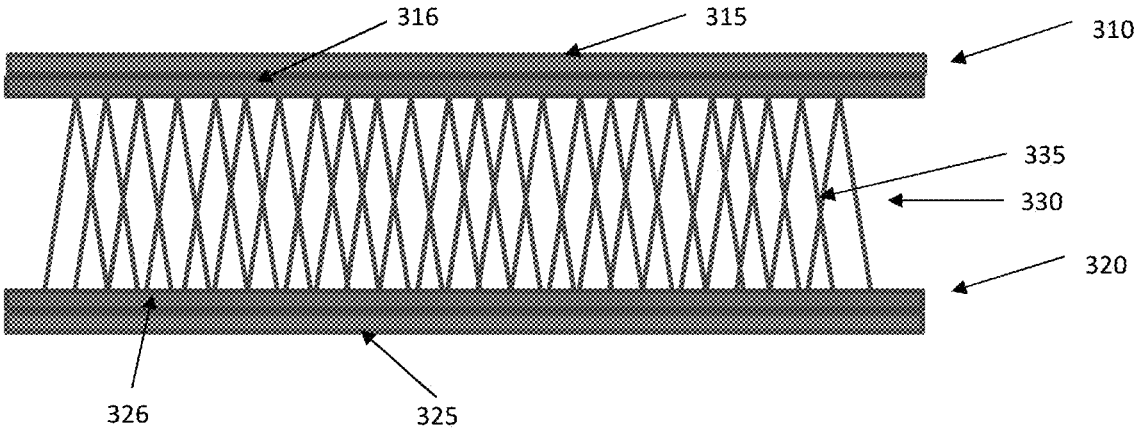
FIG. 5 shows a suitable cross-section for a fabric of the invention, in which the first and second surface layers are formed from two separate yarns.

Suitable cross-sections of the fabrics disclosed herein are depicted in FIGS. 4 and 5. FIG. 4 depicts a fabric 200 formed from a first surface layer 210 formed from a first set of yarn, a second surface layer 220 formed from a second set of yarn and a set of spacer yarn 230 between the first and second surface layers in the form of tuck stitches 235. As depicted, the first 210 and second 220 surface layers (or top and bottom surface layers) may be formed from a single main yarn material 215, 225 (which may be formed from a single material or a composite of different materials).

In some embodiments of the invention that may be mentioned herein, the first and second sets of yarns may each comprise a main yarn and a platting yarn, where each main yarn forms an outer surface and the platting yarn forms an interior surface of the respective first and second surface layers. As used in this context, the outer surface of the first and second surface layers refers to the exterior side of the respective layer, i.e. the surface of the first and second surface layers that is exposed to the environment or a wearer's body. The inner surface of the first and second surface layers refers to the interior surface of the respective layer, i.e. the surface of the first and second surface layers that is within the fabric product and exposed to the set of spacer yarns, and is not exposed to the environment or body of a wearer. This may be beneficial when the fabric product is intended to have specific functionality. For example, a wicking yarn may be used on an exterior surface that is intended to be in contact with the body of a wearer, to assist with wicking moisture away from a wearer's skin. In contrast, a water repellent yarn might be desirable on an exterior surface that is intended to be exposed to the environment, in order to prevent the fabric product from becoming overly wet or saturated with moisture when worn outside in the rain. FIG. 5 depicts a further possible embodiment of a fabric according to the invention 300, where the first 310 and second 320 surface layers are formed from two separate yarns, that is a main yarn 315, 325 and a platting yarn 316, 326, with a set of spacer yarn 330 between the first and second surface layers in the form of tuck stitches 335. It will be appreciated that the main yarns 315, 325 form an outer surface (i.e. the surface in contact with the outer environment) of the respective surface layers, while the platting yarns 316, 326 form the inner surface (i.e. the surface pointing to the interior of the fabric).

The main yarns 215, 225 in the embodiment of FIG. 4 may be any suitable material or combination of materials (e.g. the main yarns may be a filament/short staple/core spun yarn plied with yarn with or without elastic properties). More particularly, the main yarns 215, 225 may be selected from yarns that have elastic properties (e.g. single covered yarn, double covered yarn bare elastic, mechanical stretch yarn etc.). Moreover, there can be multiple types of yarns plied together (e.g. covered yarn and normal filament yarn plied together). The set of spacer yarn 230 may be formed from any suitable material—with the thickness of said material (or its elasticity) chosen to suite the desired thickness of the fabric at any given point (in combination with the density of tuck stitches).

In FIG. 5, the first and second sets of yarns may each comprise a main yarn 315, 325 and a platting yarn 316, 326, where each main yarn forms an outer surface and the platting yarn forms an interior surface of the respective first and second surface layers. The main yarns 315, 325 may be any suitable material or combination of materials (e.g. any suitable material or combination of materials as described above for FIG. 4). The platting yarns 316, 326, may either be selected from any suitable material or combination of materials or it may be selected from an elastic material. The set of spacer yarn 330 may be formed from any suitable material—with the thickness of said material (or its elasticity) chosen to suite the desired thickness of the fabric at any given point (in combination with the density of tuck stitches).

As noted above, the first set of yarn and/or the second set of yarn may comprise an elastic material. Any suitable elastic yarn may be used, as described hereinbefore. In addition, any suitable elastic material may be used. For example, the elastic material may be elastane.

The fabric generated from the knitting process may be one that has one or more of the following characteristics:

(a) a flat fabric, apart from the variable thickness;

(b) a fabric that is patterned to provide a non-free-standing 3-dimensional shape that has an internal volume defined by the surface of the first or second surface layer; and (c) a fabric that is patterned to provide a free-standing 3-dimensional shape that has an internal volume defined by the surface of the first or second surface layer, optionally wherein the first and second yarns comprise at least 15 wt % of an elastic fibre (e.g. elastane).

The material in option (a) may be present in a final product as part of the overall design or it may be moulded to form a final product. The materials in options (b) and (c) may be subjected to further moulding. The moulding enables the generation of extra depth and contouring that may not otherwise have been present in the final product.

A flat intermediate (or part of final) product described in (a) above may be achieved using any flat knit knitting machine that may be programmed to provide the desired patterning in the product produced. This may otherwise be a typical 2-dimensional knitting pattern to produce a fabric. The same holds true for the fabrics (b) and (c), except that the knitting patterns is one designed to generate a 3-dimensional pattern, which will be described in detail below.

As will be appreciated, for the fabric to be suitable for moulding it should include yarns that incorporate thermoplastics. Thermoplastic materials that may be used in yarns for fabrics intended for moulding include, but are not limited to, a polyester, a nylon, a polypropylene, a thermoplastic polyurethane (TPU), and an acrylic material. These materials may form the whole or part of certain yarns that are used herein. That is, they may form blends with other fabric materials. As will be appreciated, the thermoplastic materials need to be present in a sufficient quantity for the moulded shape to be retained after the moulding process has taken place. Therefore, the thermoplastic yarns may be present in an amount of from 10 wt %, 20 wt %, 30 wt %, 40 wt %, 50 wt %, 60 wt %, 70 wt %, 80 wt % or 90 wt %.

The mould itself will be constructed from a male and a female component that will be designed to have contours that will not deform the bi-directional thickness variation imparted to the fabric by its manufacture. The temperature and time used for the moulding with vary depending on the material used and may be readily determined by a skilled person. For example, a suitable temperature range for the moulding may be from 90 to 220° C. and a suitable time at this temperature for the fabric in the mould may be from 20 to 240 seconds.

In embodiments intended for moulding, the one or more of the sets of yarns used herein may include a thermoplastic material. Examples of thermoplastic materials that may be used herein include, but are not limited to, polyesters, nylons, polypropylenes, thermoplastic polyurethanes, acrylics, blends thereof, and combinations thereof.

Particular products that may be mentioned herein may include ones where the fabric is patterned to provide one of a bra cup, a bra cookie and a bra. In such products, the fabric may be patterned to provide one or more bra cup zones or one or more bra cookie zones. For example, wherein each bra cup or bra cookie zone is patterned to have a first, a second and a third tuck stitch region, each region having a different density of tuck stitches, such that: the first region corresponds to an outer peripheral region of the cup and has a tuck stitch density lower than the second region; the second region corresponds to a region of the cup between the first and third regions and has a tuck stitch density lower than the third region; and the third region corresponds to a central region of the cup and has a tuck stitch density higher than the first and second regions. In the same or an alternative embodiment, each bra cup or bar cookie zone may patterned to have a first, a second, a third, a fourth and a fifth spacer yarn thickness region, each region having a different thickness for the sets of spacer yarn, such that: the first region corresponds to an outer peripheral region of the cup and has a set of spacer yarn with a diameter lower than a set of spacer yarn used in the second region; the second region corresponds to a region of the cup between the first and third regions and has a set of spacer yarn with a diameter lower than a set of spacer yarn used in the third region; the third region corresponds to a central region of the cup and has a spacer yarn diameter higher than a spacer yarn used in the first and second regions; the fourth region corresponds to a region of the cup between the third and fifth regions and has a set of spacer yarn with a diameter lower than a set of spacer yarn used in the third region; and the fifth region corresponds to an outer peripheral region of the cup and has a set of spacer yarn with a diameter lower than a set of spacer yarn used in the fourth region. An example of this arrangement is depicted in FIGS. 2 and 3.

For the avoidance of doubt, one will not see the bands in the product. Instead, it will appear as a gradual thickness variation. Even within each of the individual bands there may be some thickness variation. This is because the tuck variation and the horizontal thickness variation happen in each of the individual courses, meaning that the resulting change of thickness can be made gradually as a transition between the bands.

The fabrics disclosed herein may have a free-standing 3-dimensional shape, by which it is meant that there may be a curve (or other 3-dimensional shape) that is introduced into a surface of the fabric, such that a surface of the fabric defines a measurable volume. Suitable shapes include, but are not limited to hemispheres, hemicylinders, spheres, cylinders, open-sided cuboids, open-sided cones, open-sided pyramids, 3D-hexagons, 3D-ovals and the like. The three-dimensional shape of the fabric may be generated in part by the variable thickness of the fabric along its course and wale directions and also in part by a 3-dimensional knitting pattern. Additionally or alternatively, a free-standing 3-dimensional shape may be provided (or accentuated) by the moulding of fabrics in need thereof. For example, to introduce the desired level of 3-dimensionality and/or to introduce other properties into the final product. As will be appreciated, the depth imparted to a fabric by 3-dimensional knitting may be somewhat limited and so the used of moulding allows greater depth to be imparted to a 3-dimensionally shaped fabric that cannot be imparted by 3-dimensional knitting alone. In addition, the moulding step may allow for the fabric to include complicated design contours, such as a tear-drop shape that may not otherwise be accessible simply by knitting. Thus, in embodiments of the invention, there is provided a moulded fabric that provides a free-standing 3-dimensional shape that has an internal volume defined by the surface of the first or second surface layer.

In all embodiments of the invention relating to a product with a free-standing 3D shape, the first and/or second yarns (e.g. the first and second yarns) may comprise at least 10 wt % or, more particularly, 15 wt % of an elastic material (e.g. elastane). Without wishing to be bound by theory, it is believed that the use of elastic fibres may help the fabric product to retain its 3D shape, this is because the recovery properties of the elastic material ensure that the shape is maintained; and/or the elastic material reduced the drapeability of the fabric and provides the fabric with structural support, thereby enabling the fabric to maintain its shape. The use of elastic fibres may also add stretchability to the fabric material, leading to increased wearer comfort. This may be especially useful because the three dimensional shape of a fabric product according to the invention may not exactly conform to the three dimensional shape of the body of a wearer. Given this, the use of an elastic material may enable the fabric product to better conform to the body of a wearer. Elastic materials may also be useful in certain specific applications, such as sportswear (e.g. sports bras).

In some embodiments of the invention that may be mentioned herein, the platting yarn (when present) of the first and second sets of yarns may be formed from a yarn having elastic properties. For example, the platting yarn may comprise at least 15 wt % of an elastic material (e.g. elastane).

In some embodiments of the invention that may be mentioned herein where the fabric has a free-standing 3D shape, the fabric product may be patterned to provide one or more of a bra cup, a bra cookie, and a bra. For example, and as explained in more detail herein, the fabric product may comprise courses of different lengths that when knitted together result in a fabric product having a three-dimensional shape. This three-dimensional fabric product may therefore form, for example, a bra cup, a bra cookie or a bra.

In some embodiments of the invention that may be mentioned herein where the fabric has a freestanding 3D shape, the fabric may be a bra cup or bra cookie that is patterned to have a first, second and third tuck stitch region, each region having a different density of tuck stitches, such that:

- the first tuck stitch region corresponds to an outer peripheral region of the cup and has a tuck stitch density lower than the second region;
- the second tuck stitch region corresponds to a region of the cup between the first and third regions and has a tuck stitch density lower than the third region;

the third tuck stitch region corresponds to a central region of the cup and has a tuck stitch density higher than the first and second regions.

In some embodiments of the invention that may be mentioned herein where the fabric has a freestanding 3D shape, the fabric may be a bra cup or bra cookie that is patterned to have a first, a second, a third, a fourth and a fifth spacer yarn thickness region, each region having a different thickness for the sets of spacer yarn, such that:

the first spacer yarn thickness region corresponds to an outer peripheral region of the cup and has a set of spacer yarn with a diameter lower than a set of spacer yarn used in the second region;

the second spacer yarn thickness region corresponds to a region of the cup between the first and third regions and has a set of spacer yarn with a diameter lower than a set of spacer yarn used in the third region;

the third spacer yarn thickness region corresponds to a central region of the cup and has a spacer yarn diameter higher than a spacer yarn used in the first and second regions the fourth spacer yarn thickness region corresponds to a region of the cup between the third and fifth regions and has a set of spacer yarn with a diameter lower than a set of spacer yarn used in the third region;

the fifth spacer yarn thickness region corresponds to an outer peripheral region of the cup and has a set of spacer yarn with a diameter lower than a set of spacer yarn used in the fourth region.

Figure 6:
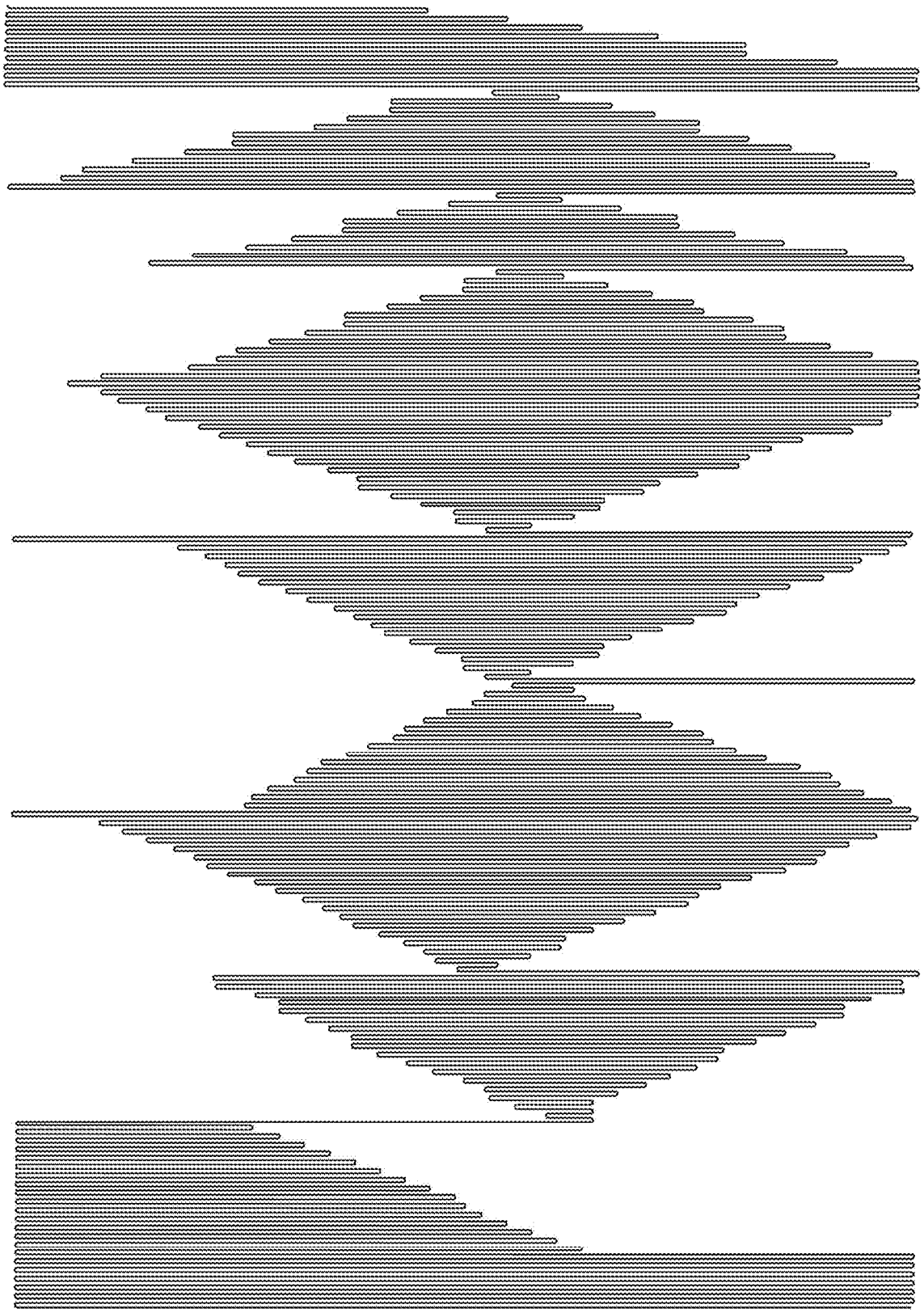
FIG. 6 shows an example of longer and shorter courses that may be used to generate a three-dimensional hemisphere for a bra cup, such as that shown in FIGS. 2 and 3.

FIG. 6 shows a plan of a knit pattern comprising longer and shorter courses, which allows the production of a fabric that may be used to generate a three-dimensional shape. When the edges of the fabric shown in FIG. 6 are brought together (which will be done during the knitting process), the resulting shape will be a 3D hemi-sphere suitable for a bra cup. As will be appreciated by a skilled person, different combinations of longer and shorter courses could be used to generate other 3D shapes.

Figure 7:
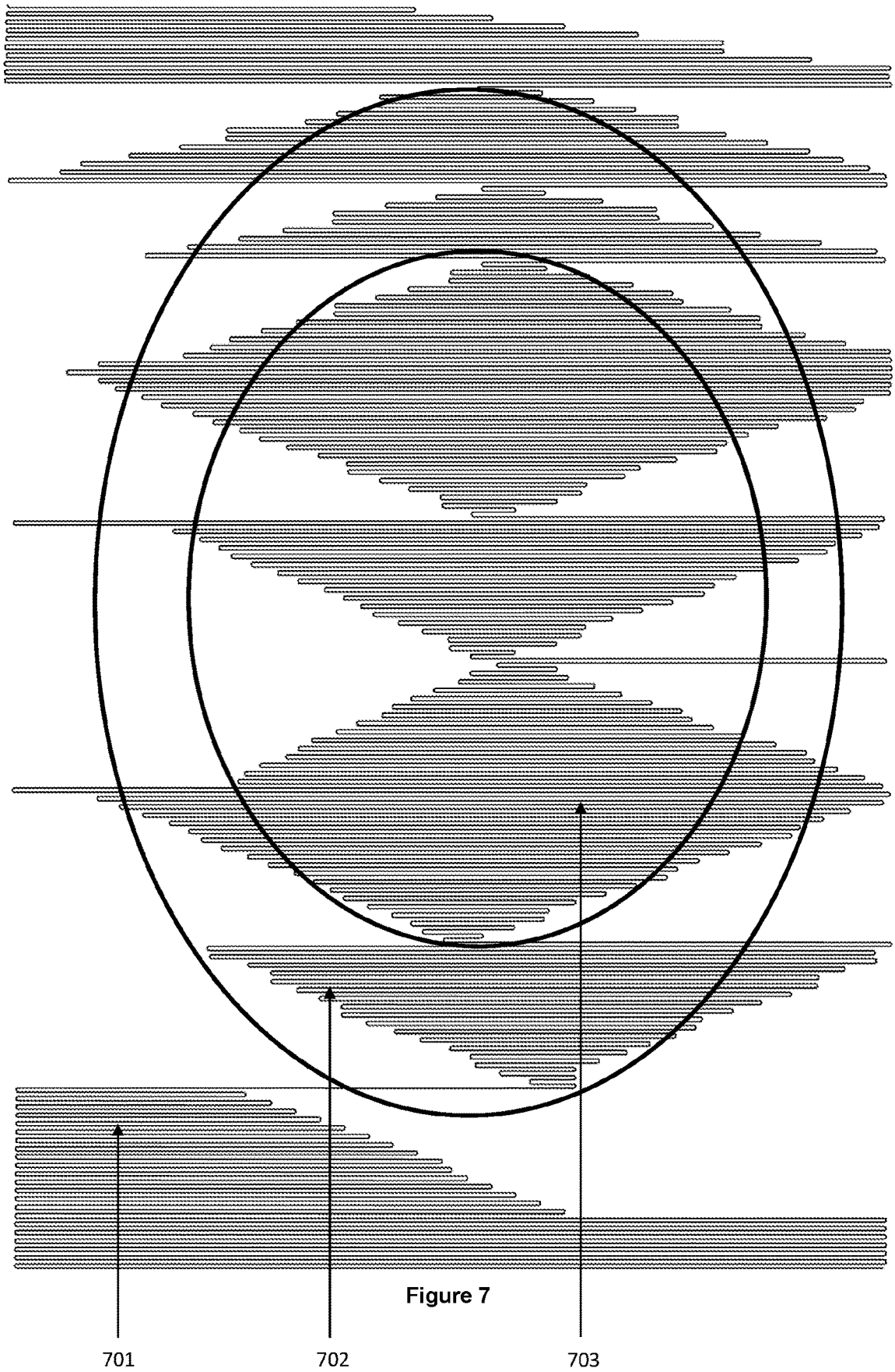
FIG. 7 shows an example of the longer and shorter courses of FIG. 6 with an overlay depicting tuck stitch density.

FIG. 7 shows the knit pattern of FIG. 6, with an overlay depicting tuck stitch density. The resulting hemi-sphere (bra cup) will have a greater thickness at the centre region of the bra cup than the outer regions. The knit pattern comprises a low tuck density region 701, a medium tuck density region 702 and a high tuck density region 703. This provides a lightweight and comfortable bra while ensuring sufficient nipple concealment and breast support.

Figure 8:
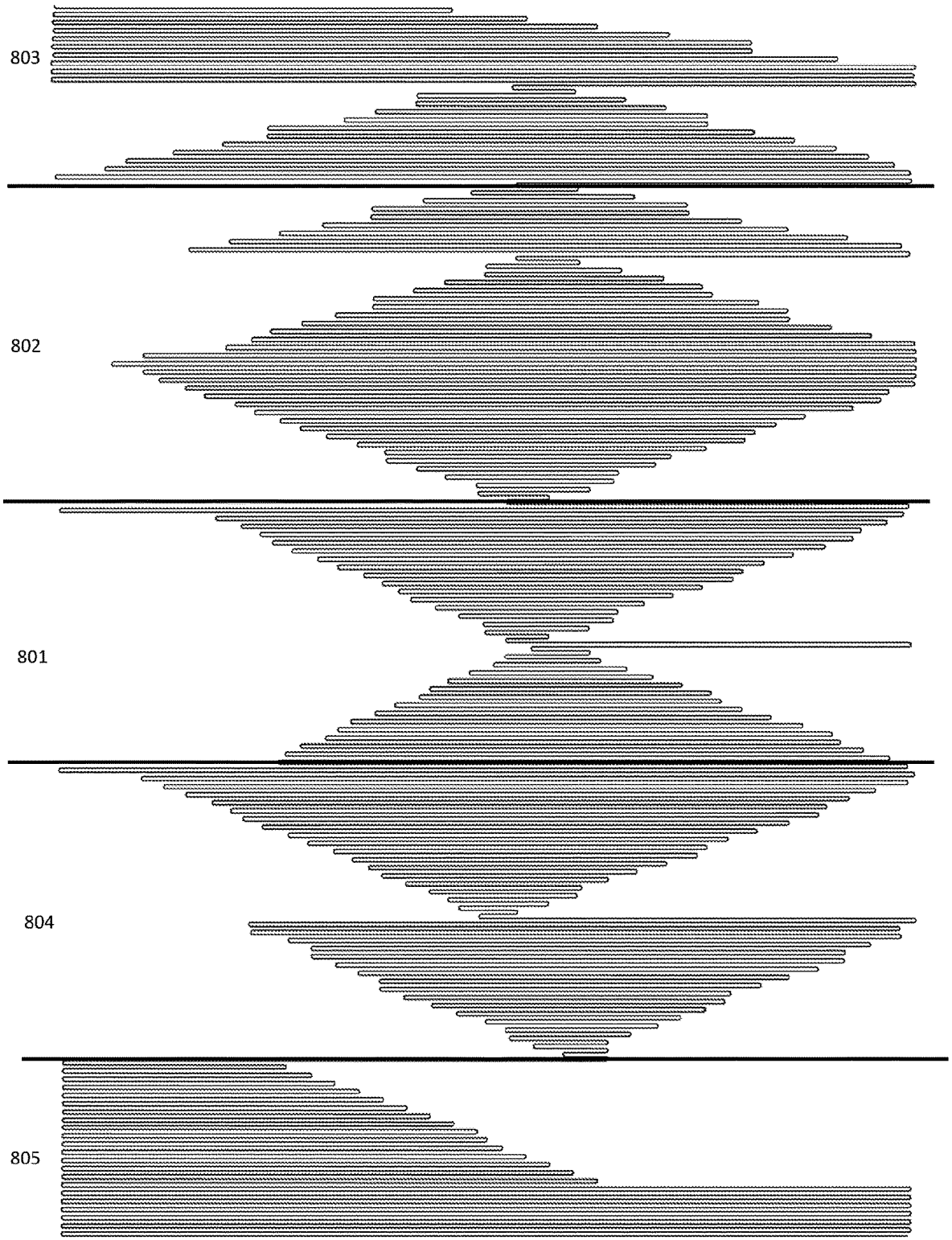
FIG. 8 shows an example of the longer and shorter courses of FIG. 6 with an overlay depicting the thickness of the spacer yarn used in the tuck stitches.

FIG. 8 shows the knit pattern of FIG. 6, with solid lines depicting regions with different sizes of yarn used in the tuck stitches (spacer yarn thickness regions). The thicker yarns are used to form the centre of the bra cup in a high spacer yarn thickness region 801. Moving away from the centre region, there is a medium spacer yarn thickness regions 802 and 804, followed by a low spacer yarn thickness regions 803 and 805. This combination results in a higher thickness at the centre region of the bra cup than the outer regions. This provides a lightweight and comfortable bra while ensuring sufficient nipple concealment and breast support.

The knitted structure shown in FIGS. 6 to 8 may be prepared as explained below. The knitting technique used to form the 3D shape is known as "holding down". In this technique, a predetermined set of loops in each course will be kept in their respective needles without knitting while the rest of the needles are knitting in the same course. As defined in the knitting pattern, the holding down needles will resume knitting when the 3D coordinates of the adjacent courses to the those are required to be knitted. This is shown in Plan 1 below.

Plan 1

| Course | | | | | | | | | | | | | | | | | | | | |
|---|---|---|---|---|---|---|---|---|---|---|---|---|---|---|---|---|---|---|---|---|
| R | X | X | X | X | X | X | X | X | X | X | X | X | X | X | X | X | X | X | X | X |
| Q | X | X | X | X | X | X | X | X | X | X | X | X | X | X | X | X | X | X | X | |
| P | X | X | X | X | X | X | X | X | X | X | X | X | X | X | X | X | X | X | X | |
| O | X | X | X | X | X | X | X | X | X | X | X | X | X | X | X | X | X | | | |
| N | | X | X | X | X | X | X | X | X | X | X | X | X | X | X | X | X | | | |
| M | | X | X | X | X | X | X | X | X | X | X | X | X | | | | | | | |
| L | | | | X | X | X | X | X | X | X | X | X | X | | | | | | | |
| K | | | | X | X | X | X | X | X | X | X | X | X | X | X | X | X | X | X | X |
| J | | | | | | | X | X | X | X | X | X | X | X | X | X | X | X | X | X |
| I | | | | | | | X | X | X | X | | | | | | | | | | |
| H | | | | | X | X | X | X | X | X | | | | | | | | | | |
| G | | | | | X | X | X | X | X | X | X | X | | | | | | | | |
| F | | | X | X | X | X | X | X | X | X | X | X | | | | | | | | |
| E | | | X | X | X | X | X | X | X | X | X | X | X | X | X | | | | | |
| D | X | X | X | X | X | X | X | X | X | X | X | X | X | X | X | | | | | |

-continued

| Plan 1 | | | | | | | | | | | | | | | | | | | | | |
|---|---|---|---|---|---|---|---|---|---|---|---|---|---|---|---|---|---|---|---|---|---|
| Course | | | | | | | | | | | | | | | | | | | | | |
| C | X | X | X | X | X | X | X | X | X | X | X | X | X | X | X | X | X | X | X | X | |
| ⇦ | | | | | | | | | | | | | | | | | | | | | |
| B | X | X | X | X | X | X | X | X | X | X | X | X | X | X | X | X | X | X | X | X | |
| ⇨ | | | | | | | | | | | | | | | | | | | | | |
| A | X | X | X | X | X | X | X | X | X | X | X | X | X | X | X | X | X | X | X | X | Start |
| ⇦ | | | | | | | | | | | | | | | | | | | | | |
| Knitting direction | 1 | 2 | 3 | 4 | 5 | 6 | 7 | 8 | 9 | 10 | 11 | 12 | 13 | 14 | 15 | 16 | 17 | 18 | 19 | 20 | |

The knitting process is as follows.

Knitting starts from right to left in course A.

Courses A, B, and C are knitted on all the needles.

Course D is knitted from left to right on needles 1 to 15, and the rest of the needles (16 to 20) are left in the "holding down" position until next knitting action, which for these needles is course J.

The returning course "E" is knitted from needles 15 to 3 (i.e. needles 1 to 2 and 16 to 20 are holding down), and the next knitting action happens only in Course J for needles 16 to 20, course M for needle 2, and course 0 for needle 1.

When used herein, the term "substantially identical" is intended to refer to a dimension that is essentially identical, but for variations introduced by the knitting machine. For example, the term may mean that a dimension varies by less than 5%, such as less than 2%, such as less than 1%, such as less than 0.5%, such as less than 0.05%, such as the dimension is essentially uniform.

In particular embodiments that may be mentioned herein, the fabric may be patterned to provide a free-standing 3-dimensional shape that has an internal volume defined by the surface of the first or second surface layer. This may be a shape that is sustained without the need for moulding. In order to achieve this shape, the fabric may be one where the first and second yarns comprise at least 10 wt % (e.g. greater than or equal to 15 wt %) of an elastic fibre (e.g. elastane). As will be understood, the 3-dimensional shape may be at least partly supplied by a 3-dimensional knitting pattern.

As will be apparent from the foregoing, the fabric product of the invention provides a number of benefits.

Bidirectional thickness variation: the thickness of the fabric product may be varied at any point by varying one or more of the density of tuck stitches and the thickness of the spacer yarn that is used to form the tuck stitches.

Functionality customisation: the yarns may be selected and positioned to provide numerous additional functionalities, for example wicking, water repellent properties, liquid retaining properties, anti-microbial properties, anti-odour properties and/or thermal comfort.

Size customisation: the thickness and volume may be varied as described above without requiring moulding or post-processing.

The invention claimed is:

1. A weft knit spacer fabric having variable thicknesses, the fabric comprising:

a first surface layer formed from a first set of yarn;

a second surface layer formed from a second set of yarn; and a set of spacer yarn between the first and second surface layers, where the fabric is formed from a plurality of courses of the sets of first, second and spacer yarns, where each course is connected to at least one other course in a wale direction, wherein the thickness is varied by varying:

the density of tuck stitches along each course, where each tuck stitch is formed by the set of spacer yarn with the first and/or second surface layers; and the thickness of the spacer yarn in each course, provided that when the fabric has a free-standing 3-dimensional shape, it is a moulded fabric.

2. The fabric according to claim 1, wherein the sets of first and second yarns each comprise an elastic material.

3. The fabric according to claim 1, wherein the first and second sets of yarns each comprise a main yarn and a platting yarn, where each main yarn forms an outer surface and the platting yarn forms an interior surface of the respective first and second surface layers.

4. The fabric according to claim 3, wherein the platting yarn of each of the first and second sets of yarns comprises a yarn with elastic properties.

5. The fabric according to claim 1, wherein the fabric is selected from one or more of:

(a) a flat fabric, apart from the variable thickness;

(b) a fabric that is patterned to provide a non-free-standing 3-dimensional shape that has an internal volume defined by the surface of the first or second surface layer, where the fabric is a moulded fabric; and (c) a fabric that is patterned to provide a free-standing 3-dimensional shape that has an internal volume defined by the surface of the first or second surface layer.

6. The fabric according to claim 1, wherein the fabric is patterned to provide one of a bra cup, a bra cookie and a bra.

7. The fabric according to claim 6, wherein the fabric is patterned to provide one or more bra cup zones or one or more bra cookie zones.

8. The fabric according to claim 7, wherein each bra cup or bra cookie zone is patterned to have a first, a second and a third tuck stitch region, each region having a different density of tuck stitches, such that:

the first region corresponds to an outer peripheral region of the cup and has a tuck stitch density lower than the second region;

the second region corresponds to a region of the cup between the first and third regions and has a tuck stitch density lower than the third region; and the third region corresponds to a central region of the cup and has a tuck stitch density higher than the first and second regions.

9. The fabric according to claim 7, wherein each bra cup or bar cookie zone is patterned to have a first, a second, a third, a fourth and a fifth spacer yarn thickness region, each region having a different thickness for the sets of spacer yarn, such that:

the first spacer yarn region corresponds to an outer peripheral region of the cup and has a set of spacer yarn with a diameter lower than a set of spacer yarn used in the second region;

the second spacer yarn region corresponds to a region of the cup between the first and third regions and has a set of spacer yarn with a diameter lower than a set of spacer yarn used in the third region;

the third spacer yarn region corresponds to a central region of the cup and has a spacer yarn diameter higher than a spacer yarn used in the first and second regions;

the fourth spacer yarn region corresponds to a region of the cup between the third and fifth spacer yarn regions and has a set of spacer yarn with a diameter lower than a set of spacer yarn used in the third region; and the fifth spacer yarn region corresponds to an outer peripheral region of the cup and has a set of spacer yarn with a diameter lower than a set of spacer yarn used in the fourth region.

10. The fabric according to claim 1, wherein the fabric is a moulded fabric that provides a free-standing 3-dimensional shape that has an internal volume defined by the surface of the first or second surface layer.

11. The fabric according to claim 1, wherein the length of all tuck stitches is substantially identical.

12. The fabric according to claim 1, wherein the fabric is patterned to provide one of a bra cup, a bra cookie and a bra.

13. The fabric according to claim 1, wherein the fabric is patterned to provide a free-standing 3-dimensional shape that has an internal volume defined by the surface of the first or second surface layer, where the fabric is a moulded fabric.

14. The fabric according to claim 13, wherein the 3-dimensional shape is at least partly supplied by a 3-dimensional knitting pattern.

15. The fabric according to claim 13, wherein the fabric is patterned to provide one of a bra cup, a bra cookie and a bra.

16. The fabric according to claim 15, wherein the fabric is one of a bra cup or a bra cookie that is patterned to have a first, second and third region, each region having a different density of tuck stitches, such that:

the first region corresponds to an outer peripheral region of the cup and has a tuck stitch density lower than the second region;

the second region corresponds to a region of the cup between the first and third regions and has a tuck stitch density lower than the third region;

the third region corresponds to a central region of the cup and has a tuck stitch density higher than the first and second regions.

17. The fabric according to claim 15, wherein each bra cup or bar cookie zone is patterned to have a first, a second, a third, a fourth and a fifth spacer yarn thickness region, each region having a different thickness for the sets of spacer yarn, such that:

the first region corresponds to an outer peripheral region of the cup and has a set of spacer yarn with a diameter lower than a set of spacer yarn used in the second region;

the second region corresponds to a region of the cup between the first and third regions and has a set of spacer yarn with a diameter lower than a set of spacer yarn used in the third region;

the third region corresponds to a central region of the cup and has a spacer yarn diameter higher than a spacer yarn used in the first and second regions;

the fourth region corresponds to a region of the cup between the third and fifth regions and has a set of spacer yarn with a diameter lower than a set of spacer yarn used in the third region;

the fifth region corresponds to an outer peripheral region of the cup and has a set of spacer yarn with a diameter lower than a set of spacer yarn used in the fourth region.

18. A garment comprising a weft knit spacer fabric having variable thicknesses as defined in claim 1.

* * * * *